US011094437B2

(12) United States Patent
Pagano et al.

(10) Patent No.: US 11,094,437 B2
(45) Date of Patent: Aug. 17, 2021

(54) NON-CORROSIVE SOFT-MAGNETIC POWDER

(71) Applicant: BASF SE, Ludwigshafen (DE)

(72) Inventors: Sandro Pagano, Mannheim (DE); Jae Hyung Hwang, Viernheim (DE); Ralf Liebscher, Ottersheim (DE); Frank Prechtl, Frankfurt (DE); Oliver Koch, Wachenheim (DE)

(73) Assignee: BASF SE, Ludwigshafen am Rhein (DE)

( * ) Notice: Subject to any disclaimer, the term of this patent is extended or adjusted under 35 U.S.C. 154(b) by 375 days.

(21) Appl. No.: 14/780,605

(22) PCT Filed: Mar. 26, 2014

(86) PCT No.: PCT/EP2014/056034
§ 371 (c)(1),
(2) Date: Sep. 28, 2015

(87) PCT Pub. No.: WO2014/154737
PCT Pub. Date: Oct. 2, 2014

(65) Prior Publication Data

US 2016/0055947 A1 Feb. 25, 2016

(30) Foreign Application Priority Data

Mar. 28, 2013 (EP) ..... 13161713

(51) Int. Cl.
*H01F 1/42* (2006.01)
*H01F 3/08* (2006.01)
(Continued)

(52) U.S. Cl.
CPC ..... *H01F 1/42* (2013.01); *B22F 1/0062* (2013.01); *B22F 1/02* (2013.01); *H01F 1/24* (2013.01);
(Continued)

(58) Field of Classification Search
CPC ..... H01F 1/42; H01F 1/24
See application file for complete search history.

(56) References Cited

U.S. PATENT DOCUMENTS 3,389,105 A * 6/1968 Bolger ..... B22F 9/04 106/403
4,652,305 A 3/1987 Ebenhoech et al.
(Continued)

FOREIGN PATENT DOCUMENTS

CN 101 525 563 A 9/2009
CN 100 588 743 C 2/2010
(Continued)

OTHER PUBLICATIONS

An experimental survey of rust preventives in water II. The screening of organic inhibitors, P. Hersch J. B. Hare A. Robertson Sheila M. Sutherland, Journal of (Year: 1961).*
(Continued)

*Primary Examiner* — Anthony J Zimmer
*Assistant Examiner* — Jeremy C Jones
(74) *Attorney, Agent, or Firm* — Faegre Drinker Biddle & Reath LLP

(57) ABSTRACT

The invention relates to a soft-magnetic powder comprising a core of a soft-magnetic material and a coating, the coating comprising an insulation treatment compound and an inhibitor, the inhibitor being:

(e) a carboxylic acid with the general formula (I)

(I)

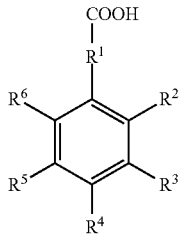

wherein $R^1$ is a single bond or $C_1$-$C_6$-alkylene, $R^2$ to $R^6$ are each independently H, OH, —X—COOH, $C_1$-$C_6$-alkyl, $C_2$-$C_6$-alkenyl, $C_2$-$C_6$-alkynyl, $C_3$-$C_7$-cycloalkyl, $C_6$-$C_{12}$-aryl, $COOR^7$, $OR^8$, or two adjacent groups $R^2$ to $R^6$ together form a ring, X is a single bond or $C_1$-$C_6$-alkylene; $R^7$, $R^8$ are $C_1$-$C_{20}$-alkyl; or a salt of the carboxylic acid, and/or (f) a compound of the general formula (II)

$$(R^9\text{—O—})(R^{10}\text{—O—})(R^{11}\text{—O—})PO \quad \text{(II)}$$

wherein $R^9$ to $R^{11}$ independently of each other indicate $C_1$-$C_{20}$-alkyl, $C_2$-$C_{20}$-alkenyl, $C_2$-$C_6$-alkynyl, $C_3$-$C_7$-cycloalkyl, $C_6$-$C_{12}$-aryl, unsubstituted or substituted with one or more groups selected from OH and $NH_2$, or $R^9$ to $R^{11}$ are each independently a polydiol moiety having a molecular weight $M_W$ of 500 to 30000 g/mol which is optionally capped at the end by —$C_1$-$C_{20}$-alkyl and/or at the connection to O atom bonding to P by $C_1$-$C_{20}$-alkylene, or $R^{10}$, $R^{11}$ are each independently H.

The invention further relates to a process for producing the soft-magnetic powder and an electronic component comprising the soft-magnetic powder.

20 Claims, No Drawings

(51) Int. Cl.

| | |
|---|---|
| ***H01F 41/02*** | (2006.01) |
| ***B22F 1/00*** | (2006.01) |
| ***H01F 1/24*** | (2006.01) |
| ***B22F 1/02*** | (2006.01) |
| *H01F 1/26* | (2006.01) |

(52) U.S. Cl.
CPC ..... *H01F 3/08* (2013.01); *H01F 41/0206* (2013.01); *C22C 2202/02* (2013.01); *H01F 1/26* (2013.01)

(56) References Cited

U.S. PATENT DOCUMENTS

| | | | | |
|---|---|---|---|---|
| 5,085,690 | A | 2/1992 | Ebenhoech et al. | |
| 6,475,404 | B1 * | 11/2002 | Carlson | H01F 1/447 252/62.53 |
| 6,645,286 | B2 | 11/2003 | Ostertag et al. | |
| 10,074,468 | B2 * | 9/2018 | Inagaki | H01F 41/0246 |
| 2002/0169244 | A1 * | 11/2002 | Ostertag | B22F 1/0007 524/440 |
| 2009/0085002 | A1 | 4/2009 | Omura et al. | |
| 2009/0087684 | A1 * | 4/2009 | Omura | B22F 1/0062 428/800 |

FOREIGN PATENT DOCUMENTS

| | | | | |
|---|---|---|---|---|
| DE | 3 428 121 | A1 | | 2/1986 |
| DE | 3 940 347 | A1 | | 6/1991 |
| EP | 0 765 199 | A1 | | 4/1997 |
| EP | 0810615 | A2 | | 12/1997 |
| JP | S58221202 | A | | 12/1983 |
| JP | H09-251911 | A | | 1/1997 |
| JP | 2009-266973 | A | | 11/2009 |
| JP | 2009266973 | A | * | 11/2009 |
| JP | 2011-146417 | A | | 7/2011 |
| WO | WO-96/02345 | A1 | | 2/1996 |
| WO | WO-2006/071226 | A1 | | 7/2006 |
| WO | WO-2007084363 | A2 | | 7/2007 |

OTHER PUBLICATIONS

Guilminot, E., Dalard, F., & Degrigny, C. (May 1, 2005). Effect of Phosphate Concentration on the Corrosion of Iron in Water? Polyethylene Glycol Mixtures. NACE International. (Year: 2005).*

International Search Report for PCT/EP2014/056034 dated Jul. 4, 2014.

International Preliminary Report on Patentability received for PCT Patent Application No. PCT/EP2014/056034, dated Jul. 8, 2015, 13 pages.

* cited by examiner

NON-CORROSIVE SOFT-MAGNETIC POWDER

CROSS-REFERENCE TO RELATED APPLICATIONS

This application is a national stage application (under 35 U.S.C. § 371) of PCT/EP2014/056034, filed Mar. 26, 2014, which claims benefit of European Application No. 13161713.6, filed Mar. 28, 2013, both of which are incorporated herein by reference in their entirety.

The invention relates to a process of preparing non-corrosive soft-magnetic powder. The invention further relates to a product prepared by the process as well as the use of such a soft-magnetic powder.

Iron-based powders have long been used as a base material in the manufacture of electronic components. Other uses of such powders include metal injection molded parts, powder metallurgy, and various specialty products, such as food supplement.

A popular application of soft-magnetic powder includes magnetic core components, which serve as piece of magnetic material with a high permeability used to confine and guide magnetic fields in electrical, electromechanical and magnetic devices such as electromagnets, transformers, electric motors, inductors and magnetic assemblies. These components are usually produced in different shapes and sizes by molding soft-magnetic powder in a die under high pressure.

In electronic applications, particularly in alternating current (AC) applications, the two key characteristics of the magnetic core component are the magnetic permeability and the core loss characteristic. In this context, the magnetic permeability of a material provides an indication of its ability to become magnetized or its ability to carry a magnetic flux. Permeability is defined as the ratio of the induced magnetic flux to the magnetizing force or field intensity. When a magnetic material is exposed to a rapidly varying field, the total energy of the core is reduced by the occurrence of hysteresis losses and/or eddy current losses. The hysteresis loss is caused by the necessary expenditure of energy to overcome the retained magnetic forces within the core component. The eddy current loss is caused by the production of electric currents in the core component due to the changing flux caused by AC conditions and basically results in a resistive loss.

Generally, devices for high frequency applications are sensitive to core losses and in order to reduce losses due to eddy currents an improved insulating property is desired. The simplest way of achieving this is thickening the insulating layer for each particle. Furthermore, it has been found that rust causes reduction in resistance and a rust inhibiting layer can reduce such losses. However, the thicker the insulation layer is, the lower the core density of soft-magnetic particles gets and the magnetic flux density decreases. Furthermore, an attempt to increase the magnetic flux density by compression-molding under high pressure may lead to larger strain in the core and, hence, to a higher hysteresis loss.

In order to manufacture a soft-magnetic powder core having optimal key characteristics, it is necessary to increase the resistivity and the density of the core simultaneously. For this reason, particles would ideally be covered with a thin insulating layer having a high insulating property. In the field of magnetic powders different approaches to this problem exist.

WO 2007/084 363 A2 relates to a method for preparing metallurgical powder compositions and compacted articles made thereof. The metallurgical powder composition comprises a base-metal powder, which is at least partially coated by metal phosphate and a particulate internal lubricant. The internal lubricants used include, for example, polyamides. $C_5$ to $C_{30}$ fatty acids, metal salts of polyamides, metal salts of $C_5$ to $C_{30}$ fatty acids, ammonium salts of $C_5$ to $C_{30}$ fatty acids, lithium stearate, zinc stearate, manganese stearate, calcium stearate, ethylene bis-stearamide, polyethylene waxes, polyolefins, and combinations thereof. Through the combination of phosphate coating and internal lubricant the lubricity of the metal particles and the compacted parts can be increased, while reducing the amount of organic compounds present.

EP 0 810 615 B1 describes a soft-magnetic powder composite core, which comprises particles with insulating layers. In particular, the soft-magnetic particles are treated by a solution comprising a phosphating solution, which comprises a solvent and phosphate salts. Additionally, the solution comprises a surfactant and a rust inhibitor, which is an organic compound containing nitrogen and/or sulfur having a lone pair of electrons suppressing the formation of iron oxide.

EP 0 765 199 B1 discloses admixing powder compositions of iron-based particles with a thermo-plastic material and a lubricant selected from the group of stearates, waxes, paraffins, natural and synthetic fat derivatives and oligomers of polyamide type. The obtained mixture is compacted at a temperature below the glass-transition temperature or melting point of the thermo-plastic resin and the compacted product is heated in order to cure the thermoplastic resin. With the lubricant added to the thermoplastic material the process is less time consuming, but an essential improvement in the soft-magnetic properties cannot be reached.

Furthermore, in the field of metal processing, especially metal surface structures, different insulating layers are utilized to eliminate corrosion. CN 101 525 563 A for example refers to an after polishing detergent including a corrosion inhibitor that is used to protect the surface of a processing object from corrosion, when the chemical-mechanical polishing-cleaning is carried out. CN 100 588 743 A discloses an acid solution for treating magnesium alloy surfaces, which comprises two acids, a corrosion inhibitor and a wetting agent for activation of magnesium alloy surface to form a compact film.

WO2006/071226 discloses a process for removing oxides from the surface of a workpiece and forming an iron phosphate on the surface of the workpiece. For this purpose, the workpiece is treated with an aqueous solution comprising dissolved phosphate anions, dissolved acid, dispersed aromatic carboxylic acid an a viscosity increasing agent. However, preventing carbonyl iron powder which is used for producing electrical or electronic components from corrosion by using such a solution results in reduced resistivity and permeability of electrical or electronic components made of such treated carbonyl iron powder.

Known processes for forming insulating layers on magnetic particles typically tackle one of the key characteristics, i.e. the density or the insulation properties, while keeping the other constant. Therefore, the resistivity and magnetic permeability obtainable are limited. Hence, there is still a need in the art to further improve the process of treating soft-magnetic powders in order to reach optimal results for magnetic core components prepared from such powders while achieving a better corrosion protection.

Therefore, it is an object of the invention to provide a soft-magnetic powder and a process for producing corresponding soft-magnetic powder that facilitates to achieve high resistivity, high permeability and non-corrosive properties when utilized in magnetic core components. Furthermore, it is an object of the invention to provide a process which allows achieving aforementioned goals in a simple, cost-effective and uncomplicated manner. Another object of the invention is to provide electronics components including soft-magnetic powder, which require no further corrosion protection. In this context, one object of the invention is to provide soft-magnetic powder that allows producing electronic components without further corrosion protection layers.

These objects are achieved by a soft-magnetic powder comprising coated particles of a soft-magnetic material, the coating comprising an insulation treatment compound and an inhibitor, the inhibitor being:

(a) a carboxylic acid with the general formula (I)

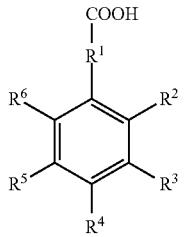

(I)

wherein $R^1$ is a single bond or $C_1$-$C_6$-alkylene, $R^2$ to $R^6$ are each independently H, OH, —X—COOH, $C_1$-$C_6$-alkyl, $C_2$-$C_6$-alkenyl, $C_2$-$C_6$-alkynyl, $C_3$-$C_7$-cycloalkyl, $C_6$-$C_{12}$-aryl, $COOR^7$, $OR^8$, or two adjacent groups $R^2$ to $R^6$ together form a ring, X is a single bond or $C_1$-$C_6$-alkylene;

$R^7$, $R^6$ are $C_1$-$C_{20}$-alkyl;

or a salt of the carboxylic acid, and/or (b) a compound of the general formula (II)

$$(R^9—O—)(R^{10}—O—)(R^{11}—O—)PO \quad (II)$$

wherein $R^9$ to $R^{11}$ independently of each other indicate $C_1$-$C_{20}$-alkyl, $C_2$-$C_{20}$-alkenyl, $C_2$-$C_6$-alkynyl, $C_3$-$C_7$-cycloalkyl, $C_6$-$C_{12}$-aryl, unsubstituted or substituted with one or more groups selected from OH and $NH_2$, or $R^9$ to $R^{11}$ are each independently a polydiol moiety having a molecular weight $M_W$ of 500 to 30000 g/mol which is optionally capped at the end by —$C_1$-$C_{20}$-alkyl and/or at the connection to O atom bonding to P by $C_1$-$C_{20}$-alkylene, or $R^{10}$, $R^{11}$ are each independently H.

For the purposes of the present invention a salt of the carboxylic acid includes carboxylates which are preferably derivatives of a carboxylic acid function, in particular a metal carboxylate, a carboxylic ester function or a carboxamide or function. These include, for example, the esters with $C_1$-$C_4$-alkanoles such as methanol, ethanol, n-propanol, isopropanol, n-butanol, sec-butanol and tert-butanol.

The objects are further achieved by a process for producing a soft-magnetic powder comprising following steps:

(a) coating particles of a soft-magnetic material with a solution comprising an insulation treatment compound, (b) coating the insulated particles of the soft-magnetic material with a solution comprising an inhibitor solved in an organic solvent;

(c) coating the insulated particles of the soft-magnetic material with a resin, wherein all coatings are applied in individual steps (a) to (c) or wherein steps (a) and (b) or wherein steps (b) and (c) are carried out in one step and wherein any solution used for coating the soft-magnetic core comprises less than 10 vol % water based on the total volume of the solution.

Preferably, each solution used for coating the soft-magnetic material comprises less than 5 vol % water and particularly, the amount of water in each solution is lower than 2 vol %. In a particularly preferred embodiment an aqueous solution of 85% phosphoric acid is used as insulation treatment compound and all water in the solutions is the water of the phosphoric acid.

Particularly, the inhibitor used for coating the soft-magnetic core is a carboxylic acid of the general formula (I) or a salt of the carboxylic acid or a compound of the general formula (II) as described above.

If at least one of the groups $R^2$ to $R^6$ of the carboxylic acid of the general formula (I) is $COOR^7$, $OR^8$, $R^7$ and $R^8$ preferably are methyl, ethyl, n-propyl, isopropyl, n-butyl, sec-butyl and tert-butyl. The invention provides a soft-magnetic powder which is optimally suitable for manufacturing electronic components. In particular, the soft-magnetic powder coated according to the invention allows to achieve high resistivity, high permeability and non-corrosive properties when used for manufacture of electronic components, such as magnetic core components.

The process for producing the soft-magnetic powder according to the invention further allows to flexibly adapt such characteristics by modifying the treatment solution and the inhibitor content used therein. Furthermore, owing to the simple and uncomplicated manner of the proposed method, a high batch-to-batch consistency can be achieved, which again allows for reliable production of electronic components. Overall, the soft-magnetic powder coated according to the invention facilitates to prepare electronic components with unique electromagnetic performance characteristics. Additionally, electronic components comprising the soft-magnetic powder coated according to the invention do not require further layers for corrosion protection saving space and production costs.

The insulation treatment compound preferably is a phosphate comprising compound, particularly phosphorus acid. By treating the soft-magnetic core with such a phosphate comprising compound, the soft-magnetic material is coated with an insulating amorphous compound, such as phosphoric acid or salts thereof with at least one element selected from the group consisting of Al, Si, Mg, Y, Ca, B, Zr, and Fe. Since these materials provide reasonably good insulation properties and sufficiently couple a metal to an organic compound, they are particularly suitable for coating the soft-magnetic powder. Furthermore, the coating with the insulation treatment compound prepares the surface of the powder particles such that the inhibitor(s) adhere more easily.

The average thickness of the coating comprising the insulation treatment compound and the inhibitor may lie between 1 nm to 1 μm, preferred between 1 and 50 nm. In addition, the amount of the coating with respect to the soft-magnetic material is not higher than 4 wt %, thus, a significant decrease in magnetic flux density of the magnetic core obtained by molding the soft-magnetic powder can be prevented.

One method of coating the soft-magnetic core with an insulation treatment compound includes mixing the soft-magnetic powder with phosphoric acid or salts thereof optionally mixed with an organic solvent. The person skilled in the art may choose an appropriate time and appropriate temperature conditions to form an iron phosphate layer. The coating with the insulation treatment compound may for example be carried out at room temperature for a period of 10 min to 10 hours. The solvent may then be evaporated by elevating the temperature to form dry powder. In case the anti-corrosion treatment compound comprises a phosphate comprising compound, after coating the soft-magnetic core the phosphor content typically varies between 0.01 and 1%, preferably between 0.02 and 0.5% by weight of the dry powder.

If the inhibitor is a carboxylic acid of the general formula (I) or a salt of the carboxylic acid, a sodium salt of benzoic acid or a derivative with at least one of the groups $R^2$ to $R^6$ being a hydroxyl group or mixtures thereof are preferred. Particularly preferred are derivatives with at least one hydroxyl group adjacent to the carboxylic acid group.

If the inhibitor is a compound of the general formula (II), compounds are preferred with R9 to R11 or R9 and R10 or R10 being a polydiol moiety, particularly polyethylene glycol, polypropylene glycol or poly ethylene/propylene glycol or mixtures thereof. The polydiol moiety preferably has a molar weight $M_w$ of 1000 to 10000 g/mol.

In case a mixture of a carboxylic acid of the general forumula (I) or a salt of the carboxylic acid and a compound of the general formula (II) is used as an inhibitor, the weight ratio of carboxylic acid or salt of the carboxylic acid and the compound of the general formula (II) is in a range from 0.1 to 10, particularly in a range from 1 to 4.

In the context of the present invention specifications in % by weight (wt %) refer to the fraction of the total weight of soft-magnetic powder unless otherwise specified.

A soft-magnetic powder of the present invention includes a plurality of particles composed of a soft-magnetic material. Such powders comprise particles with a mean size between 0.5 and 250 μm, preferably between 2 and 150 μm, more preferably between 2 and 10 μm. These particles may vary in shape. In respect of the shape, numerous variants known to the person skilled in the art are possible. The shape of the powder particles may, for example, be needle-shaped, cylindrical, plate-shaped, teardrop-shaped, flattened or spherical. Soft-magnetic particles with various particle shapes are commercially available. Preferred is a spherical shape as such particles can be coated more easily, which in fact results in a more effective insulation against electrical current.

As soft-magnetic material an elemental metal, an alloy or a mixture of one or more elemental metal(s) with one or more alloy(s) may be employed. Typical elemental metals comprise Fe, Co and Ni. Alloys may include Fe-based alloys, such as Fe—Si alloy, Fe—Si—Cr alloy, Fe—Si—Ni—Cr alloy, Fe—Si—B—Cr alloy, Fe—Si—B—Cr—C alloy, Fe—Al alloy, Fe—N alloy, Fe—Ni alloy, Fe—C alloy, Fe—B alloy, Fe—Co alloy, Fe—P alloy, Fe—Ni—Co alloy, Fe—Cr alloy, Fe—Mn alloy, Fe—Al—Si alloy and ferrites, or rare earth Fe-based alloy, such as Nd—Fe—B alloy, Sn—Fe—N alloy, Sm—Co alloy, Sm—Co—Fe—Cu—Zr alloy and Sr-ferrite. In a preferred embodiment Fe or Fe-based alloys, such as Fe—Si—Cr, Fe—Si or Fe—Al—Si, serve as soft-magnetic material.

In a particularly preferred embodiment Fe serves as soft-magnetic material and the soft-magnetic powder is a carbonyl iron powder. Carbonyl iron can be obtained according to known processes by thermal decomposition of iron pentacarbonyl in a gas phase, as described, for example, in Ullmann's Encyclopedia of Industrial Chemistry, 5th Edition, Vol. A 14, page 599 or in DE 3 428 121 or in DE 3 940 347, and contains particularly pure metallic iron.

Carbonyl iron powder is a grey, finely divided powder of metallic iron having a low content of secondary constituents and consisting essentially of spherical particles having a mean particle diameter of up to 10 μm. Unreduced carbonyl iron powder, which is preferred in the present context, has an iron content of >97% by weight (here based on the total weight of the powder), a carbon content of <1.5% by weight, a nitrogen content of <1.5% by weight and an oxygen content of <1.5% by weight. Reduced carbonyl iron powder, which is particularly preferred in the process of the present invention, has an iron content of >99.5% by weight (here based on the total weight of the powder), a carbon content of <0.1% by weight, a nitrogen content of <0.01% by weight and an oxygen content of <0.5% by weight. The mean diameter of the powder particles is preferably from 1 to 10 μm and their specific surface area (BET of the powder particles) is preferably from 0.2 to 2.5 $m^2/g$.

In a particularly preferred embodiment, the soft-magnetic powder additionally comprises a resin. Preferred resins are epoxy resin, urethane resin, polyurethane resin, phenolic resin, amino resin, silicon resin, polyamide resin, polyimide resin, acrylic resin, polyester resin, polycarbonate resin, norbornene resin, styrene resin, polyether sulfone resin, silicon resin, polysiloxane resin, fluororesin, polybutadiene resin, vinyl ether resin, polyvinyl chloride resin or vinyl ester resin. Particularly preferred resins are epoxy resin based on bisphenol A or F, novolac type epoxy resins or aliphatic epoxy resin.

For producing the soft-magnetic powder according to the invention it is possible to apply the coatings in individual steps. However, in a preferred embodiment the coatings (a) and (b) or the coatings (b) and (c) are applied in one step.

If the coatings are applied in individual steps, the soft-magnetic material is treated in a first step with a solution comprising the insulation treatment compound. In a second step, the soft-magnetic material is treated with a solution comprising the inhibitor and in a third step, the soft-magnetic material is treated with a solution comprising the resin.

In case the coatings (a) and (b) are carried out in one step, the soft magnetic material is treated with a solution comprising the insulation treatment compound and the inhibitor in a first step and with the resin comprising solution in a second step.

For the third embodiment, in which the coatings (b) and (c) are applied in one step, the soft-magnetic material is treated with a solution comprising the insulation treatment compound in a first step and with a solution comprising inhibitor and resin in a second step.

In a preferred embodiment, each solution contains at least one solvent. Particularly suitable solvents are acetone, acetic acid, aceton-nitrile, glycerin, hexane, methyl t-butyl ether, propanol, benzene, ethanol or methanol. Examples of other suitable solvents are aromatic hydrocarbons, such as toluene or xylene; alkyl esters, such as methyl acetate, ethyl acetate, propyl acetate, butyl acetate, isobutyl acetate, isopropyl acetate, and 3-methylbutanol; alkoxy alcohols, such as methoxypropanol, methoxybutanol, ethoxypropanol; alkylbenzenes, such as ethylbenzene, isopropylbenzene; butyl glycol, butyl diglycol, alkyl glycol acetates, such as butyl glycol acetate and butyl diglycol acetate; 2-methoxy-1-methylethyl acetate, diglycol dialkyl ethers, diglycol monoalkyl ethers, dipropylene glycol dialkyl ethers, dipropylene glycol monoalkyl ethers, diglycol alkyl ether acetates, dipropylene glycol alkyl ether acetates, ethers, such as dioxane and tetrahydrofuran, lactones, such as butyrolactone; ketones, such as acetone, 2-butanone, cyclohexanone, methyl ethyl ketone (MEK), methyl isobutyl ketone (MIBK); methylphenol (ortho-, meta-, or para-cresol), pyrrolidones, such as N-methyl-2-pyrrolidone; dimethylformamide, and also mixtures made of two or more of these solvents.

The solvent content in the solution may amount up to 50 wt %. Preferably the solvent content lies between 20 and 5 wt %.

Each solution may be prepared by mixing the compound for the coating with the solvent. For treating the soft-magnetic material, in a preferred embodiment, the prepared solution then is mixed with the soft-magnetic material. The method of mixing these components is not limited, and the mixing may be effected by a mixer, e.g. stirred tank, planetary mixer, paddle mixer or a kneader. After mixing the soft-magnetic powder and the solution including a solvent the mixture may be heated for the solvent to evaporate. In this manner a dry soft-magnetic powder is provided, that includes a non-corrosive thin coating.

The average thickness of the inhibitor coating may lie between 0.5 nm to 20 nm. In addition, the ratio of inhibitor coating to the soft-magnetic material is not higher than 0.1 and preferably not higher than 0.01. Thus a significant decrease in magnetic flux density of the magnetic core obtained by molding the soft-magnetic powder can be prevented.

The invention also concerns the use of the treated soft-magnetic powder for manufacturing electronic components, in particular magnetic core components as used in electrical, electromechanical and magnetic devices such as electromagnets, transformers, electric motors, inductors and magnetic assemblies. Further uses of the coated soft-magnetic powder include manufacture of Radio-Frequency Identification (RFID) tags and manufacture of elements reflecting or shielding electromagnetic radiation.

Electronic components such as magnetic cores may be obtained by e.g. press molding or injection molding the soft-magnetic powder. If the soft-magnetic powder does not comprise a coating of a resin, it is necessary to mix the soft-magnetic powder with a resin. In case a soft-magnetic powder with a resin comprising coating is used, it is possible to add additional resin. The resin the soft-magnetic powder is mixed with preferably is the same as the resin the soft-magnetic powder may be coated with. The method of mixing the soft-magnetic powder and the resin is not limited, and the mixing may be effected by a mixer, e.g. ribbon blender, tumbler. Nauta mixer, Henschel mixer or supermixer or kneading machine, e.g., Banbury mixer, kneader, roll, kneader-ruder, paddle mixer, planetary mixer or monoaxial or biaxial extruder.

The composition is used to produce a magnetic or magnetisable molding. Particular moldings of this type are coil cores or coil formers, as used in electrical engineering. Coils with corresponding coil cores or coil formers are used by way of example as electromagnets, in generators, in laptop computers, in netbooks, in mobile telephones, in electric motors, in AC inverters, in electronic components in the automobile industry, in toys, and in the electronics industry. The composition can moreover be used to produce magnetic-field concentrators.

To produce a molding, the composition of soft-magnetic powder and resin is heated and molten at a melting point of the resin, preferably the thermoplastic resin, component, and then formed into an electronic component, such as a magnetic core of desired shape. Than the composition is compressed in a mold to give a molding. The compression produces a molding which has high strength.

Another method to produce the molding includes the composition of soft-magnetic powder and resin, which is pressed in a mold at pressures up to 1000 MPa, preferably up to 600 MPa with or without heating. After compression the molding is left to cure.

Powder injection molding allows to produce complex metal parts cost effectively and efficiently. Powder injection molding typically includes pressing the soft-magnetic powders together with a polymer as adhesive into the desired shape, the adhesive is then removed and the powder is compacted into a solid metal part in the sintering phase. This works particularly well with carbonyl-iron powder because the spherical iron particles can be packed together very tightly.

In the production of RFID tags (Radio-Frequency Identification), which are labels in the size of rice grains for automatic object localization or identification, soft-magnetic powder may be employed in printing the RFID structure.

Lastly, electronic components manufactured of soft-magnetic powder may be used for shielding electronic devices. In such applications, alternating magnetic field of the radiation causes the powder particles to continuously rearrange themselves. Due to the resulting friction, the powder particles convert the energy of the electromagnetic waves into heat.

EXAMPLES

Preparation of Carbonyl Iron Powder

In the examples, 2.2 kg of carbonyl iron powder (CIP) were filled into a 1.2 L coated tinplate beaker, which was placed into a planetary mixer. After inerting by flushing with $N_2$, a solution containing 380 mL of acetone, 4.2 g 85% H3PO4 and inhibitor are added. The composition of respective solutions and the results are given in Table 1.

After stirring the slurry with planetary mixer by 30-100 r/min for 30 min at room temperature, the temperature was raised above the boiling point of acetone. After 3 to 4 hours of heat treatment the dry powder was ready to use.

In the comparative example V1 the carbonyl iron powder has been treated with the $H_3PO_4$ comprising solution without additional inhibitor.

Mixing with Epoxy Resin

The coated CIP powder (100 g) was mixed with epoxy resin (Epikote 1004, Momentive) by dissolving the epoxy resin (2.8 g) in a solvent (20 mL; e.g. acetone, methylethylketone) and addition of 0.14 g of (dicyandiamide) Dyhard 100SH (Firma=Alzchem) as hardener. In a glass beaker the coated CIP is stirred together with the epoxy formulation using a dissolver mixer (IKA, RW20 D2M, 1000 R/min). After mixing the slurry is poured in an aluminum plate, which is then put in a fume hood for 8 h. The resulting dry CIP epoxy plate is milled in a knife mill (Kinematica, Microtron MB550) for 10 seconds to yield the ready to press powder.

Molding and Wiring of Ring Core 6.8 g (±0.1 g) of the ready to press powder is put into a steel mold (ring type: outer diameter 20.1 mm; inner diameter 12.5 mm; resulting height approximately 5-6 mm) and molded at 440 MPa for a couple of seconds. From the exact mass and height of the ring the density of the ring core is calculated. The ring core is wired (20 windings) with an isolated 0.85 mm copper wire (Isodraht, Multogan 2000MH 62) for determination of the permeability and resistivity.

Measurement of Permeability and Resistivity

An LRC meter (E4980A Agilent) was used to measure permeability of a ring core. All measurements were done at 100 kHz with 0V DC bias. The test AC current of 10 mA was applied to the ring core.

To measure the resistivity of the pressed parts, a power supply was connected in series to a voltmeter and a sample. 300 Volts were applied to a multimeter and the sample connected in series. Voltage reading of a multimeter was used to estimate the resistance of the sample using following equation.

$$R_{sample}=R_{meter}\times(V_{PS}-V_{meter})/V_{meter},$$

where $R_{sample}$ is the resistance of the cylinder, $R_{meter}$ is the internal resistance of the meter, $V_{PS}$ is the applied voltage from power supply (=300V), and $V_{meter}$ the reading from the voltmeter.

Corrosion Test

The used corrosion test is an accelerated test compared to standard climate chamber tests at 85° C. and 85% relative humidity. It results in accelerated corrosion as the specimen is placed directly into water.

A molded ring core as described above is placed upright into a plastic petri dish (Ø 33 mm, 12 mm height). The petri dish is filled with distilled water in a way that half of the ring core is immersed in water. The open petri dish is placed into climate chamber set to 85° C. and 85% relative humidity. After 24 h the petri dish was removed from the climate chamber inspected. If no corrosion is observed the petri dish is filled again with distilled water and is placed into climate chamber set to 85° C. and 85% relative humidity. This is done to a maximum of 7 days. The corrosion resistance was evaluated by inspection of the ring core: + corresponds to no traces of corrosion even after 7 days (168 h); 0 corresponds to corrosion in the range between 48 h to 168 h; – corresponds to corrosion before reaching 48 h.

Test Results

After treatment of the carbonyl iron powder and formation of the compacted samples the permeability, resistivity and the corrosion characteristics were determined as described above.

TABLE 1

Test results

| Example no. | Inhibitor | amount of inhibitor in the solution [g] | permeability | resistivity [MΩ] | corrosion characteristics |
|---|---|---|---|---|---|
| V1 | — | — | 22 | 370 | – |
| 1 | 2,5-Dihydroxybenzoic acid | 6.6 | 21 | 220 | 0 |
| 2 | 2,6-Dihydroxybenzoic acid | 6.6 | 21 | 37 | 0 |
| 3 | Salicylic acid | 6.6 | 21 | 280 | 0 |
| 4 | Sodium benzoate | 6.6 | 23 | 88 | + |
| 5 | Sodium 2,5-dihydroxybenzoate | 6.6 | 21 | 2600 | + |
| 6 | Sodium salicylate | 6.6 | 21 | 290 | + |
| 7 | Inhibitor A | 1.1 | 23 | 78 | 0 |
| 8 | Inhibitor A | 2.2 | 21 | 1100 | + |
| 9 | Inhibitor A | 6.6 | 21 | 4700 | + |

In the table inhibitor A is a compound of the general formula (II) wherein $R^9$ is a polypropylene glycol chain having a molar weight $M_w$ of 1500 to 2500 g/mol which can be purchased as Korantin LUB® by BASF SE.

The invention claimed is:

1. A dry soft-magnetic powder comprising coated particles of a soft-magnetic material, the coating comprising (i) an insulation treatment compound which comprises phosphorous acid and (ii) an inhibitor, the inhibitor being (a) or (b) or a combination of (a) and (b):

(a) sodium salt of a carboxylic acid with the general formula (I) or mixtures thereof (I)

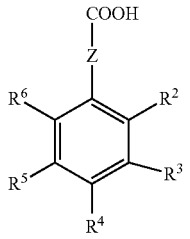

wherein Z is a single bond, $R^2$ to $R^6$ are each independently H, OH, —X—COOH, $C_1$-$C_6$-alkyl, $C_2$-$C_6$-alkenyl, $C_2$-$C_6$-alkynyl, $C_3$-$C_7$-cycloalkyl, $C_6$-$C_{12}$-aryl, $COOR^7$, $OR^8$, or two adjacent groups $R^2$ to $R^6$ together form a ring, X is a single bond or $C_1$-$C_6$-alkylene;

$R^7$, $R^8$ are $C_1$-$C_{20}$-alkyl;

wherein at least one of $R^2$ or $R^6$ is a hydroxyl group;

(b) compound of the general formula (II)

$$(R^9\text{—O—})(R^{10}\text{—O—})(R^{11}\text{—O—})PO \quad \text{(II)}$$

wherein $R^9$ is a polydiol moiety having a molecular weight $M_W$ of 500 to 30,000 g/mol which is optionally capped at the end by —$C_1$-$C_{20}$-alkyl and/or at the connection to O atom bonding to P by $C_1$-$C_{20}$-alkylene, wherein the polydiol moiety is polyethylene glycol, polypropylene glycol or poly ethylene/propylene glycol, $R^{10}$ is independently H or a polydiol moiety having a molecular weight $M_W$ of 500 to 30,000 g/mol which is optionally capped at the end by —$C_1$-$C_{20}$-alkyl and/or at the connection to O atom bonding to P by $C_1$-$C_{20}$-alkylene, wherein the polydiol moiety is polyethylene glycol, polypropylene glycol or polyethylene/propylene glycol, $R^{11}$ is independently H or a polydiol moiety having a molecular weight $M_W$ of 500 to 30,000 g/mol which is optionally capped at the end by —$C_1$-$C_{20}$-alkyl and/or at the connection to O atom bonding to P by $C_1$-$C_{20}$-alkylene, wherein the polydiol moiety is polyethylene glycol, polypropylene glycol or poly ethylene/propylene glycol, and wherein a ratio of the inhibitor coating to the soft magnetic material being not higher than 0.1.

2. The dry soft-magnetic powder according to claim 1, wherein the soft-magnetic material is carbonyl iron powder.

3. The dry soft-magnetic powder according to claim 1, wherein the coating further comprises a resin.

4. The dry soft-magnetic powder according to claim 3, wherein the resin is an epoxy resin, urethane resin, polyurethane resin, phenolic resin, amino resin, silicon resin, polyamide resin, polyimide resin, acrylic resin, polyester resin, polycarbonate resin, norbornene resin, styrene resin, polyether sulfone resin, silicon resin, polysiloxane resin, fluororesin, polybutadiene resin, vinyl ether resin, polyvinyl chloride resin or vinyl ester resin.

5. A process for producing the dry soft-magnetic powder according to claim 1, comprising following steps:

(a) coating particles of a soft-magnetic material with a solution comprising an insulation treatment compound, (b) coating the insulated particles of the soft-magnetic material with a solution comprising an inhibitor solved in an organic solvent;

(c) coating the insulated particles of the soft-magnetic material with a resin, wherein all coatings are applied in individual steps (a) to (c) or wherein steps (a) and (b) or wherein steps (b) and (c) are carried out in one step and wherein any solution used for coating the soft-magnetic core comprises less than 10 vol % of water based on the total volume of the solution and wherein the ratio of the inhibitor coating to the soft magnetic material being not higher than 0.1.

6. The process according to claim 5, wherein the inhibitor is (a) or (b) or a combination of (a) and (b)

(a) a salt of a carboxylic acid with the general formula (I)

(I)

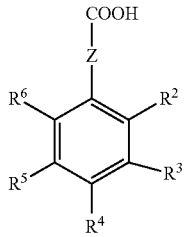

wherein Z is a single bond, $R^2$ to $R^6$ are each independently H, OH, —X—COOH, $C_1$-$C_6$-alkyl, $C_2$-$C_6$-alkenyl, $C_2$-$C_6$-alkynyl, $C_3$-$C_7$-cycloalkyl, $C_6$-$C_{12}$-aryl, $COOR^7$, $OR^8$, or two adjacent groups $R^2$ to $R^6$ together form a ring, X is a single bond or $C_1$-$C_6$-alkylene;

$R^7$, $R^8$ are $C_1$-$C_{20}$-alkyl;

wherein at least one of $R^2$ or $R^6$ is a hydroxyl group, (b) a compound of the general formula (II)

$$(R^9—O—)(R^{10}—O—)(R^{11}—O—)PO \quad (II)$$

wherein $R^9$ to $R^{11}$ are each independently a polydiol moiety having a molecular weight $M_w$ of 500 to 30000 g/mol which is optionally capped at the end by —$C_1$-$C_{20}$-alkyl and/or at the connection to O atom bonding to P by $C_1$-$C_{20}$-alkylene, wherein the polydiol moiety is polyethylene glycol, polypropylene glycol or polyethylene/propylene glycol, or $R^{10}$, $R^{11}$ besides the definition above can also be each independently H.

7. The process according to claim 5, wherein the soft-magnetic material comprises carbonyl iron powder.

8. An electronic component comprising the dry soft-magnetic powder according to claim 1.

9. The dry soft-magnetic powder according to claim 1, wherein $R^9$ to $R^{11}$ are each independently a polydiol moiety having a molecular weight $M_w$ of 1,000 to 10,000 g/mol.

10. The dry soft-magnetic powder according to claim 1, wherein $R^9$ is a polypropylene glycol having a molecular weight of 1,500 to 2,500 g/mol.

11. The dry soft-magnetic powder according to claim 1, wherein the ratio of the inhibitor coating to the soft magnetic material being not higher than 0.01.

12. The dry soft-magnetic powder according to claim 1, wherein the inhibitor is a).

13. A process for the manufacture of an electronic component which comprises press molding or injecting molding the dry soft-magnetic powder according to claim 1.

14. A dry soft-magnetic powder comprising coated particles of a soft-magnetic material, the coating comprising an insulation treatment compound and an inhibitor, the inhibitor being a compound of the general formula (II)

$$(R^9—O—)(R^{10}—O—)(R^{11}—O—)PO \quad (II)$$

wherein $R^9$ is a polydiol moiety having a molecular weight $M_W$ of 500 to 30,000 g/mol which is optionally capped at the end by —$C_1$-$C_{20}$-alkyl and/or at the connection to O atom bonding to P by $C_1$-$C_{20}$-alkylene, wherein the polydiol moiety is polyethylene glycol, polypropylene glycol or poly ethylene/propylene glycol, $R^{10}$ is independently H or a polydiol moiety having a molecular weight $M_W$ of 500 to 30,000 g/mol which is optionally capped at the end by —$C_1$-$C_{20}$-alkyl and/or at the connection to O atom bonding to P by $C_1$-$C_{20}$-alkylene, wherein the polydiol moiety is polyethylene glycol, polypropylene glycol or polyethylene/propylene glycol, $R^{11}$ is independently H or a polydiol moiety having a molecular weight $M_W$ of 500 to 30,000 g/mol which is optionally capped at the end by —$C_1$-$C_{20}$-alkyl and/or at the connection to O atom bonding to P by $C_1$-$C_{20}$-alkylene, wherein the polydiol moiety is polyethylene glycol, polypropylene glycol or poly ethylene/propylene glycol.

15. A dry soft-magnetic powder comprising coated particles of a soft-magnetic material, the coating comprising an insulation treatment compound, an epoxy resin and an inhibitor, the inhibitor being (a) or (b) or a combination of (a) and (b):

(a) a salt of a carboxylic acid with the general formula (I)

(I)

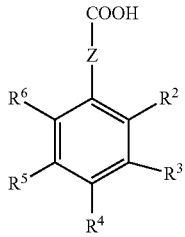

wherein Z is a single bond, $R^2$ to $R^6$ are each independently H, OH, —X—COOH, $C_1$-$C_6$-alkyl, $C_2$-$C_6$-alkenyl, $C_2$-$C_6$-alkynyl, $C_3$-$C_7$-cycloalkyl, $C_6$-$C_{12}$-aryl, $COOR^7$, $OR^8$, or two adjacent groups $R^2$ to $R^6$ together form a ring, X is a single bond or $C_1$-$C_6$-alkylene;

$R^7$, $R^8$ are $C_1$-$C_{20}$-alkyl;

wherein at least one of $R^2$ or $R^6$ is a hydroxyl group;

(b) a compound of the general formula (II)

$$(R^9—O—)(R^{10}—O—)(R^{11}—O—)PO \quad (II)$$

wherein $R^9$ is a polydiol moiety having a molecular weight $M_W$ of 500 to 30,000 g/mol which is optionally capped at the end by —$C_1$-$C_{20}$-alkyl and/or at the connection to O atom bonding to P by $C_1$-$C_{20}$-alkylene, wherein the polydiol moiety is polyethylene glycol, polypropylene glycol or poly ethylene/propylene glycol, $R^{10}$ is independently H or a polydiol moiety having a molecular weight $M_W$ of 500 to 30,000 g/mol which is optionally capped at the end by —$C_1$-$C_{20}$-alkyl and/or at the connection to O atom bonding to P by $C_1$-$C_{20}$-alkylene, wherein the polydiol moiety is polyethylene glycol, polypropylene glycol or polyethylene/propylene glycol, $R^{11}$ is independently H or a polydiol moiety having a molecular weight $M_W$ of 500 to 30,000 g/mol which is optionally capped at the end by —$C_1$-$C_{20}$-alkyl and/or at the connection to O atom bonding to P by $C_1$-$C_{20}$-alkylene, wherein the polydiol moiety is polyethylene glycol, polypropylene glycol or poly ethylene/propylene glycol.

16. The dry soft-magnetic powder according to claim 15, wherein the insulation treatment compound is a phosphate comprising compound.

17. The dry soft-magnetic powder according to claim 15, wherein a ratio of the inhibitor coating to the soft magnetic material being not higher than 0.01.

18. The dry soft-magnetic powder according to claim 15, wherein the inhibitor is a).

19. The dry soft-magnetic powder according to claim 15, wherein the insulation treatment compound is a phosphoric acid or salts thereof with at least one element selected from the group consisting of Al, Si, Mg, Y, Ca, B, Zr, and Fe.

20. A process for the manufacture of an electronic component which comprises press molding or injecting molding the dry soft magnetic powder according to claim 15.

* * * * *